US011678696B2

(12) United States Patent
Seo et al.

(10) Patent No.: US 11,678,696 B2
(45) Date of Patent: Jun. 20, 2023

(54) SMOKING PRODUCT TO WHICH TRIPLE CARE TECHNOLOGY FOR REDUCING TOBACCO SMELL IS APPLIED

(71) Applicant: KT&G CORPORATION, Daejeon (KR)

(72) Inventors: Man Seok Seo, Daejeon (KR); Hyoung Seok Lee, Daejeon (KR); Hyun Suk Cho, Daejeon (KR); Jong Yeol Kim, Daejeon (KR); Seung Hwan Lee, Daejeon (KR); Ik Pyo Lee, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 381 days.

(21) Appl. No.: 16/955,488

(22) PCT Filed: Oct. 30, 2019

(86) PCT No.: PCT/KR2019/014409
§ 371 (c)(1),
(2) Date: Jun. 18, 2020

(87) PCT Pub. No.: WO2021/040131
PCT Pub. Date: Mar. 4, 2021

(65) Prior Publication Data

US 2021/0212358 A1 Jul. 15, 2021

(30) Foreign Application Priority Data

Aug. 23, 2019 (KR) ..... 10-2019-0103697

(51) Int. Cl.
*A24D 3/06* (2006.01)
*A24D 1/00* (2020.01)
(Continued)

(52) U.S. Cl.
CPC ..... *A24D 3/061* (2013.01); *A24D 1/002* (2013.01); *A24D 1/027* (2013.01); *A24D 1/045* (2013.01); *A24D 3/14* (2013.01)

(58) Field of Classification Search
None
See application file for complete search history.

(56) References Cited

U.S. PATENT DOCUMENTS 4,700,725 A 10/1987 Geiszler, Jr.
8,393,334 B2 3/2013 Cecchetto et al.
(Continued)

FOREIGN PATENT DOCUMENTS

CN 105228474 A 1/2016
CN 105813484 A 7/2016
(Continued)

OTHER PUBLICATIONS

Office Action issued from Korean Patent Application No. 10-2019-0103697 dated Dec. 4, 2019.
(Continued)

*Primary Examiner* — Dennis R Cordray
(74) *Attorney, Agent, or Firm* — Sughrue Mion, PLLC

(57) ABSTRACT

A smoking product includes: a smoking material portion which is wrapped by a smoking material wrapper; a filter portion whose upstream end portion is combined with the smoking material portion, which includes a capsule containing a flavoring, and which is wrapped by a filter wrapper; and a tipping wrapper which surrounds at least a partial region of the smoking material portion and the filter portion so that the smoking material portion and the filter portion are combined, wherein the tipping wrapper includes a first perforation region including a plurality of perforations formed along an outer circumferential surface of the tipping wrapper and a second perforation region including a plural-
(Continued)

ity of perforations formed downstream of the first perforation region and along the outer circumferential surface of the tipping wrapper, and the capsule is disposed downstream of the first perforation region and upstream of the second perforation region.

22 Claims, 6 Drawing Sheets

(51) Int. Cl.

| | |
|---|---|
| ***A24D 1/02*** | (2006.01) |
| ***A24D 3/14*** | (2006.01) |
| ***A24D 1/04*** | (2006.01) |

(56) References Cited

U.S. PATENT DOCUMENTS

| | | | | |
|---|---|---|---|---|
| 2005/0000531 | A1* | 1/2005 | Shi | A24B 15/287 131/347 |
| 2011/0030709 | A1* | 2/2011 | Sebastian | A24D 1/025 131/365 |
| 2011/0232663 | A1* | 9/2011 | Kadiric | A24D 3/041 131/338 |
| 2014/0026908 | A1 | 1/2014 | Motodamari et al. | |
| 2018/0064161 | A1 | 3/2018 | Kaihatsu et al. | |
| 2020/0229490 | A1* | 7/2020 | Motodamari | A24D 3/04 |
| 2020/0397038 | A1* | 12/2020 | Koyama | A24B 15/283 |

FOREIGN PATENT DOCUMENTS

| | | | |
|---|---|---|---|
| CN | 108024572 | A | 5/2018 |
| EP | 1 098 036 | B1 | 1/2006 |
| EP | 3 501 304 | A1 | 6/2019 |
| EP | 2 789 248 | B1 | 1/2020 |
| GB | 2549803 | A | 11/2017 |
| JP | WO2016/181843 | A1 | 11/2016 |
| JP | 2018-529338 | A | 10/2018 |
| KR | 10-2012-0066190 | A | 6/2012 |
| TW | 201703655 | A | 2/2017 |
| WO | 2012/156703 | A1 | 11/2012 |
| WO | 2013/084786 | A1 | 6/2013 |
| WO | 2014/068295 | A1 | 5/2014 |

OTHER PUBLICATIONS

International Search Report for PCT/KR2019/014409 dated May 22, 2020 (PCT/ISA/210).

Communication dated Apr. 7, 2021, issued by the Intellectual Property Office of Taiwan in application No. 109105461.

Communication dated Dec. 7, 2021, issued by the Japanese Patent Office in application No. 2020-512846.

Extended European Search Report dated Oct. 26, 2021 in European Application No. 19880938.6.

Communication dated Jan. 15, 2021, issued by the Australian Patent Office in application No. 2019320617.

Office Action dated Jul. 12, 2022 from the China National Intellectual Property Administration in CN Application No. 201980004584.0.

* cited by examiner

SMOKING PRODUCT TO WHICH TRIPLE CARE TECHNOLOGY FOR REDUCING TOBACCO SMELL IS APPLIED

TECHNICAL FIELD

The disclosure relates to a smoking product, and more particularly, to a smoking product capable of reducing a tobacco smell on fingers, bad breath, and sidestream smoke while preventing deterioration of the taste of tobacco smoke sensed by a smoker.

BACKGROUND ART

Tobacco smoke generated through smoking can be classified into mainstream smoke that is delivered to the mouth by passing through a tobacco filter and sidestream smoke that is released into the atmosphere without passing through the filter.

Components causing an unpleasant smell that are included in the mainstream smoke and the sidestream smoke may stay on the fingers of a smoker who grips a cigarette and cause an unpleasant smell and may cause bad breath after smoking. Environmental tobacco smoke (ETS) can cause discomfort not only to smokers but also to people around them.

Thus, there is a need to develop a smoking product capable of minimizing a tobacco smell clinging to fingers during smoking, reducing bad breath after smoking, and reducing discomfort felt by non-smokers due to secondhand smoke.

DISCLOSURE

Technical Problem

The disclosure is directed to providing a smoking product capable of reducing a tobacco smell on fingers, bad breath, and sidestream smoke.

Objectives of the disclosure are not limited to the above-mentioned objective, and other unmentioned objectives should be clearly understood by those of ordinary skill in the art to which the disclosure pertains from the description below.

Technical Solution

One aspect of the disclosure provides a smoking product including: a smoking material portion which is wrapped by a smoking material wrapper; a filter portion whose upstream end portion is combined with the smoking material portion, which includes a capsule containing a flavoring, and which is wrapped by a filter wrapper; and a tipping wrapper which surrounds at least a partial region of the smoking material portion and the filter portion so that the smoking material portion and the filter portion are combined, wherein the tipping wrapper includes a first perforation region including a plurality of perforations formed along an outer circumferential surface of the tipping wrapper and a second perforation region including a plurality of perforations formed downstream of the first perforation region and along the outer circumferential surface of the tipping wrapper, and the capsule is disposed downstream of the first perforation region and upstream of the second perforation region.

The filter portion may include a first filter whose upstream end portion is combined with the smoking material portion and which includes the capsule and a second filter whose upstream end portion is combined with a downstream end portion of the first filter, and the filter wrapper may include a first wrapper which surrounds the first filter, a second wrapper which surrounds the second filter, and a combining wrapper which surrounds the first filter and the second filter so that the first filter and the second filter are combined.

An axial length of the first filter may be less than an axial length of the second filter. For example, a ratio of the axial length of the first filter to the axial length of the second filter may be 1:1.1 to 1:1.4. The axial length of the first filter may be between 11 mm to 13 mm, and the axial length of the second filter may be 14 mm to 16 mm.

The first perforation region may be disposed in a region overlapping the first filter, and the second perforation region may be disposed in a region overlapping the second filter. The first perforation region may be formed to pass through the tipping wrapper but not pass through the combining wrapper and the first wrapper, and the second perforation region may be formed to pass through the tipping wrapper, the combining wrapper, and the first wrapper.

The first perforation region may be disposed to be spaced 23 mm to 27 mm apart from a downstream end portion of the smoking product in an upstream direction, the second perforation region may be disposed to be spaced 10 mm to 14 mm apart from the downstream end portion of the smoking product in the upstream direction, and a central point of the capsule may be disposed to be spaced 19 mm to 23 mm apart from the downstream end portion of the smoking product in the upstream direction.

A separation distance between the central point of the capsule and the first perforation region may be less than or equal to a separation distance between the central point of the capsule and the second perforation region. More specifically, a ratio of the separation distance between the central point of the capsule and the first perforation region to the separation distance between the central point of the capsule and the second perforation region may be 1:2 to 1:2.5.

A porosity of each of the first wrapper and the combining wrapper may be 23,000 CU or higher, a porosity of the second wrapper may be 10 CU to 50 CU, and a porosity in the first perforation region of the tipping wrapper may be 90 CU to 210 CU.

A filler in which magnesium oxide and calcium carbonate are mixed may be applied to the smoking material wrapper, and the filler may have a weight ratio of 20% to 40% with respect to the total weight of the smoking material wrapper. A weight ratio of the magnesium oxide and the calcium carbonate which are included in the filler may be 1:5.5 to 2.5:1. For example, with respect to the total weight of the smoking material wrapper, the magnesium oxide may have a weight ratio of 5% to 25%, and the calcium carbonate may have a weight ratio of about 5% to about 25%.

A basis weight of the smoking material wrapper may be 35 $g/m^2$ to 65 $g/m^2$, and a porosity thereof may be 3 CU to 10 CU.

The smoking material wrapper may include an inner wrapper which comes in contact with the smoking material portion and surrounds the smoking material portion and an outer wrapper which comes in contact with the inner wrapper and surrounds an outer portion of the inner wrapper.

A basis weight of the inner wrapper may be less than or equal to a basis weight of the outer wrapper. The basis weight of the inner wrapper may be 20 $g/m^2$ to 30 $g/m^2$, a weight ratio of the filler with respect to the total weight of the inner wrapper may be 20% to 40%, and a porosity of the inner wrapper may be 40 CU to 50 CU. The basis weight of the outer wrapper may be 20 g/m$^2$ to 40 g/m$^2$, a weight ratio of the filler with respect to the total weight of the outer wrapper may be 20% to 40%, and a porosity of the outer wrapper may be 40 CU to 50 CU.

The capsule may include a first flavoring material containing menthol, lime oil, methyl salicylate, and peppermint oil. A ratio of the menthol and the lime oil contained in the first flavoring material may be 10:1 to 15:1, and a ratio of the lime oil and the methyl salicylate contained in the first flavoring material may be 1.1:1 to 1.3:1.

The capsule may include a first flavoring material containing menthol, orange oil, cis-3-hexenol, and lemon oil. A ratio of the menthol and the orange oil contained in the first flavoring material may be 5:1 to 6:1, and a ratio of the orange oil and the cis-3-hexenol contained in the first flavoring material may be 7:1 to 8:1.

The second filter may be flavored with a second flavoring material containing menthol, cis-3-hexenol, and eucalyptol. The second flavoring material may further contain linalool. A ratio of the menthol and the cis-3-hexenol contained in the second flavoring material may be 40:1 to 50:1, and a ratio of the cis-3-hexenol and the linalool contained in the second flavoring material may be 1.5:1 to 1.6:1.

The second flavoring material may further contain hexanal. A ratio of the menthol and the cis-3-hexenol contained in the second flavoring material may be 35:1 to 45:1, and a ratio of the cis-3-hexenol and the hexanal contained in the second flavoring material may be 2:1 to 3:1.

Advantageous Effects

According to embodiments of the disclosure, by properly designing lengths of filter wrappers and a positional relationship between first and second perforations formed in a capsule and a filter portion, a portion of a liquid contained in the capsule that is released from the capsule due to the capsule being crushed is delivered to fingers of a smoker while the remaining portion of the liquid is efficiently delivered to the smoker's mouth together with the mainstream smoke. Therefore, it is possible to reduce a tobacco smell on the fingers of the smoker and bad breath of the smoker.

Also, by balancing physical properties of a smoking material wrapper, the filter wrappers (first and second wrappers), a combining wrapper, and a tipping wrapper, it is possible to maximize the effect of reducing sidestream smoke while preventing problems such as deterioration of the taste of tobacco smoke, extinguishing of the smoking product, and deterioration of ash integrity.

Further, via compositions of a transfer jet nozzle system (TJNS) filter flavoring liquid and a capsule flavoring liquid, it is possible to maximize the effect of reducing the amounts of components such as methyl mercaptan and dimethyl sulfide.

MODES OF THE INVENTION

Figure 1:
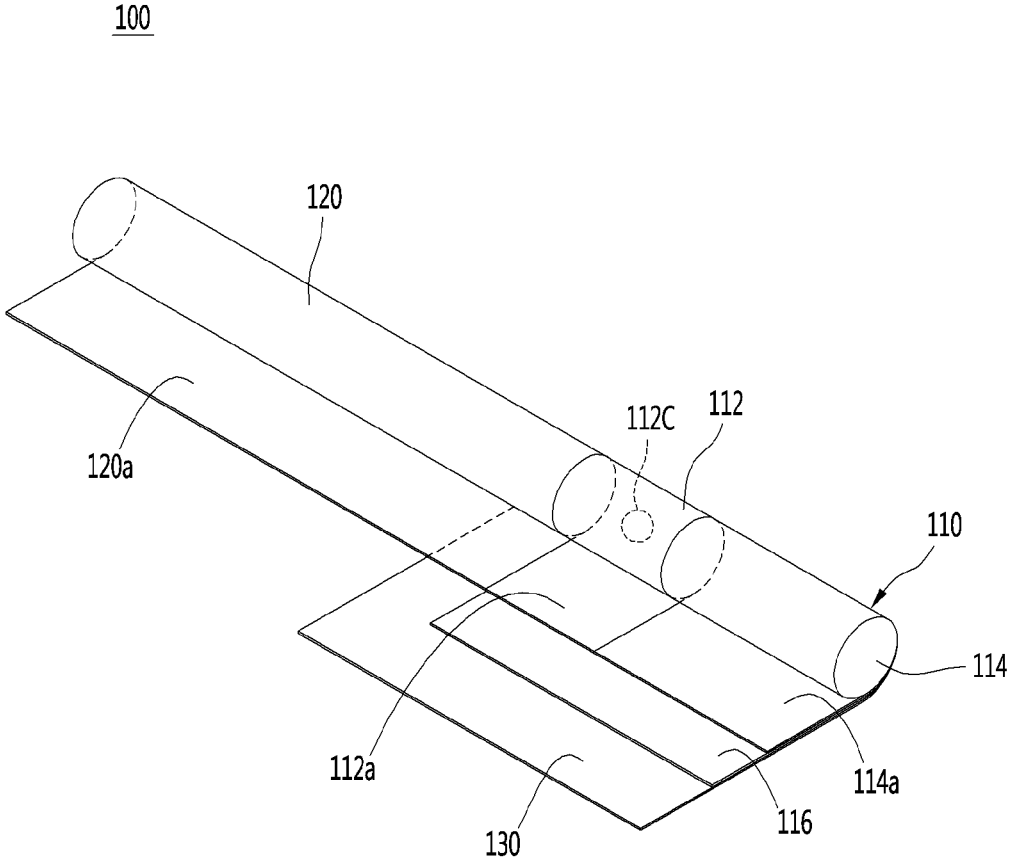
FIG. 1 is a view illustrating a schematic configuration of a smoking product according to some embodiments of the disclosure.

Hereinafter, exemplary embodiments of the disclosure will be described in detail with reference to the accompanying drawings. Advantages and features of the disclosure and a method of achieving the same should become clear with embodiments described in detail below with reference to the accompanying drawings. However, the disclosure is not limited to embodiments disclosed below and may be implemented in various other forms. The embodiments make the disclosure of the disclosure complete and are provided to completely inform one of ordinary skill in the art to which the disclosure pertains of the scope of the invention. The disclosure is defined only by the scope of the claims. Like reference numerals refer to like elements throughout.

Unless otherwise defined, all terms including technical or scientific terms used herein have the same meaning as commonly understood by one of ordinary skill in the art to which the disclosure pertains. Terms, such as those defined in commonly used dictionaries, are not to be construed in an idealized or overly formal sense unless expressly so defined herein.

Also, in the specification, a singular expression includes a plural expression unless the context clearly indicates otherwise. The terms "comprises" and/or "comprising" used herein do not preclude the presence of or the possibility of adding one or more elements, steps, and operations other than those mentioned.

Terms including ordinals such as "first" and "second" used herein may be used to describe various elements, but the elements are not limited by the terms. The terms are only used for the purpose of distinguishing one element from another element.

Throughout the specification, "smoking product" may refer to anything capable of generating an aerosol, such as tobacco (cigarette) and cigars. The smoking product may include an aerosol-generating material or an aerosol-forming substrate. Also, the smoking product may include a solid material based on tobacco raw materials, such as a reconstituted tobacco sheet, shredded tobacco, and reconstituted tobacco. A smoking material may include a volatile compound.

Also, throughout the specification, "upstream" or "upstream direction" refers to a direction moving away from an oral region of a user smoking a smoking product 100, and "downstream" or "downstream direction" refers to a direction approaching the oral region of the user smoking the smoking product 100. For example, in the smoking product 100 illustrated in FIG. 1, a smoking material portion 120 is disposed upstream of or in an upstream direction from a smoking product filter 110.

Further, in the specification, a case in which the smoking product 100 is a combustion type cigarette is described as an example. However, the disclosure is not limited thereto, and the smoking product 100 may also be a heating type cigarette or the like that is used together with an aerosol generation device (not illustrated) such as an electronic cigarette device.

FIG. 1 is a view illustrating a schematic configuration of a smoking product according to some embodiments of the disclosure.

Referring to FIG. 1, the smoking product 100 may include the smoking material portion 120, a smoking material wrapper 120*a*, the smoking product filter 110, and a tipping wrapper 130. The smoking product filter 110 may include a first filter 112, a second filter 114, a first wrapper 112*a*, a second wrapper 114*a*, a capsule 112*c*, and a combining wrapper 116.

The smoking product filter 110 may be disposed downstream of the smoking material portion and may be a region through which an aerosol material generated in the smoking material portion passes immediately before being inhaled by the user.

The first filter 112 and the second filter 114 may be formed of various materials. For example, the first filter 112 and the second filter 114 may be cellulose acetate filters. The first filter 112 and the second filter 114 may have the same dimensions and compositions, but the disclosure is not limited thereto.

For example, the first filter 112 may be a cellulose acetate filter not flavored with a flavoring material, and the second filter 114 may be a filter, e.g., a transfer jet nozzle system (TJNS) filter, flavored with a flavoring material. For example, the flavoring material with which the TJNS filter is flavored may include at least one of menthol, cis-3-hexenol, linalool, hexanal, eucalyptol, methyl salicylate, guaiacol, orange oil, lemon oil, star anise oil, peppermint oil, spearmint oil, lime oil, and ginger oil.

Meanwhile, a length 112L of the first filter 112 may be less than a length 114L of the second filter 114. This will be described in detail below with reference to FIG. 2.

In some embodiments, at least one of the first filter 112 and the second filter 114 may be a tubular structure including a hollow formed therein. The first filter 112 and/or the second filter 114 may also be manufactured by inserting structures such as films or tubes formed of the same or different materials thereinto (for example, into the hollow).

By controlling content of a plasticizer when manufacturing the first filter 112 and/or the second filter 114, a hardness of the first filter 112 and/or the second filter 114 may be adjusted.

Triacetin may be applied as a plasticizer, and triacetin may be included in an amount of 5 to 15 wt % with respect to the total weight of the first and second filters 112 and 114. However, the type and content of the plasticizer are not limited thereto and may be properly adjusted as necessary.

The capsule 112*c* may be included inside the first filter 112. The capsule 112*c* may have a structure in which a liquid contained therein including a flavoring is wrapped by a film. For example, the capsule 112*c* may have a spherical or cylindrical shape. A diameter of the capsule 112*c* may be about 2.6 mm to about 3.5 mm, but is not limited thereto, and may vary according to the specifications of the smoking product 100.

Materials forming the film of the capsule 112*c* may be a natural material, starch and/or a gellant. For example, a film made of the natural material may be composed of agar, pectin, sodium alginate, glycerin, and the like. Gellan gum or gelatin may be used as the gellant. Also, a gelation auxiliary agent may be further used as a material forming the film of the capsule 112*c*. Here, as the gelation auxiliary agent, for example, calcium chloride may be used. Also, a plasticizer may be further used as a material forming the film of the capsule 112*c*. Here, as the plasticizer, glycerin and/or sorbitol may be used. Also, a coloring agent may be further used as a material forming the film of the capsule 112*c*.

In some embodiments, as a solvent of the flavoring included in the liquid contained in the capsule 112*c*, for example, a medium chain fatty acid triglyceride (MCTG) may be used. The liquid may also contain other additives such as coloring, an emulsifier, and a thickener.

Flavorings such as menthol and essential oil of plants may be included in the liquid contained in the capsule 112*c*. In order to maximize a speed at which, after the capsule 112*c* is crushed, the flavoring included in the capsule 112*c* passes through the wrappers 112*a*, 116, and 130 and is transferred to fingers of the user, the content of the flavoring included in the capsule 112*c* may be about 20 wt % to about 50 wt % with respect to the total weight of the capsule, and the flavoring may be made of highly volatile components that may be easily released to the outside of a wrapper.

In some embodiments, the flavoring included in the capsule 112*c* may include, in addition to menthol, at least one of methyl salicylate, cis-3-hexenol, linalool, guaiacol, citronellol, citral, gamma-nonalactone, lemon oil, orange oil, rosemary oil, spearmint oil, star anise oil, sage oil, lime oil, and peppermint oil.

The first filter 112 and the second filter 114 may be wrapped by the wrappers 112*a*, 114*a*, and 116. More specifically, the first filter 112 may be wrapped by the first wrapper 112*a*, the second filter 114 may be wrapped by the second wrapper 114*a*, and the first filter 112 and the second filter 114 may be wrapped together by the combining wrapper 116. In other words, the first filter 112 wrapped by the first wrapper 112*a* and the second filter 114 wrapped by the second wrapper 114*a* may be further wrapped by the combining wrapper 116 and physically combined.

The first wrapper 112*a* and the combining wrapper 116 may be pieces of porous wrapping paper or nonporous wrapping paper. For example, the first wrapper 112*a* and the combining wrapper 116 may be pieces of nonporous wrapping paper whose porosity is, in the Cooperation Center for Scientific Research Relative to Tobacco (CORESTA) unit (CU), about 10 CU to about 50 CU or may be pieces of porous wrapping paper whose porosity is about 6500 CU or higher. Preferably, each of the first wrapper 112*a* and the combining wrapper 116 may be a piece of porous wrapping paper whose porosity is about 24,000 CU. More preferably, each of the first wrapper 112*a* and the combining wrapper 116 may be a piece of porous wrapping paper whose porosity is about 35,000 CU.

The same wrapping paper may be applied as the first wrapper 112*a* and the combining wrapper 116, but the disclosure is not limited thereto, and pieces of wrapping paper having characteristics different from each other may also be applied as the first wrapper 112*a* and the combining wrapper 116. For example, any one of the first wrapper 112*a* and the combining wrapper 116 may be porous wrapping paper, and the other one thereof may be nonporous wrapping paper.

In some embodiments, the first wrapper 112*a* and the combining wrapper 116 may be manufactured using wrapping paper not treated to be grease-resistant. That is, in order to allow a liquid, which is contained in the capsule 112*c* and is released to the outside of the capsule 112*c* when the capsule 112*c* is crushed by the smoker, to pass through the first wrapper 112*a* and the combining wrapper 116 and be delivered to fingers of the smoker, first wrapper 112*a* and the combining wrapper 116 may be manufactured using wrapping paper not treated to be grease-resistant.

The second wrapper 114*a* may be nonporous wrapping paper. For example, the second wrapper 114*a* may be nonporous wrapping paper whose porosity is about 10 CU to about 50 CU. Although not illustrated in FIG. 1, after the second filter 114 is sequentially wrapped by the second wrapper 114*a*, the combining wrapper 116, and the tipping wrapper 130 in that order, an on-line perforation operation may be performed on a partial region of the second filter 114, and accordingly, a second perforation region 114*p* (see FIG. 2) may be formed in the second filter 114 and the second wrapper 114*a*. This will be described below with reference to FIG. 2.

In some embodiments, the second wrapper 114*a* may be manufactured using grease-resistant wrapping paper. That is, in order to prevent liquid, which is contained in the capsule 112*c* and is released to the outside of the capsule 112*c* when the capsule 112*c* is crushed by the smoker, from passing through the second wrapper 114*a*, the second wrapper 114*a* may be manufactured using grease-resistant wrapping paper. In some embodiments, an aluminum foil may be further included at an inner surface of the second wrapper 114*a*.

The above-described smoking product filter 110 may be disposed downstream of the smoking material portion 120 and serve as a filter through which an aerosol material generated in the smoking material portion 120 passes immediately before being inhaled by the user.

The smoking material portion 120 may contain an aerosol-generating material. For example, the smoking material portion 120 may include tobacco strands. The smoking material portion 120 may have the form of an elongated rod and may have various lengths and diameters.

In some embodiments, the aerosol-generating material may include at least one of glycerin, propylene glycol, ethylene glycol, dipropylene glycol, diethylene glycol, triethylene glycol, tetraethylene glycol, and oleyl alcohol.

In some embodiments, the smoking material portion 120 may also contain other additives such as a flavoring agent, a wetting agent, and/or an acetate compound. For example, the flavoring agent may include licorice, saccharose, fructose syrup, isosweet, cocoa, lavender, cinnamon, cardamom, salary, fenugreek, cascarilla, white sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, coffee, or the like. Also, the wetting agent may include glycerin, propylene glycol, or the like.

In some embodiments, the smoking material portion 120 may include a reconstituted tobacco material which is formed in the shape of a rod or the like by grinding tobacco raw materials, mixing a solvent and various additives with the grinded tobacco raw materials to make a tobacco slurry, drying the tobacco slurry to form a tobacco sheet, and then processing the tobacco sheet. For example, the smoking material portion 120 may include a plurality of tobacco material strands, and each strand may have a length of about 10 mm to about 14 mm (for example, 12 mm), a width of about 0.8 mm to about 1.2 mm (for example, 1 mm), and a thickness of about 0.08 mm to about 0.12 mm (for example, 0.1 mm), but the disclosure is not limited thereto.

Since the smoking material portion 120 includes a plurality of strand materials formed by processing a wide tobacco sheet, a density of tobacco materials contained in the smoking material portion 120 may increase. Accordingly, the amount of aerosol generated may be increased, and tobacco smoke characteristics of the smoking material portion 120 may be improved.

The smoking material portion 120 may be wrapped by the smoking material wrapper 120*a*.

Meanwhile, a portion of tobacco smoke generated in a combustion process of a general smoking material portion 120 is released into the atmosphere through the smoking material wrapper 120*a* before passing through a tobacco filter, and sidestream smoke causes discomfort to non-smokers who are exposed to secondhand smoke. There have been various attempts to reduce sidestream smoke, such as applying a filler made of magnesium oxide, titanium oxide, cerium oxide, aluminum oxide, calcium carbonate, zirconium carbonate, and the like to the conventional cigarette paper. However, when the sidestream smoke is reduced by only applying such a filler, problems such as deterioration of the taste of tobacco smoke, extinguishing of the smoking product, and deterioration of ash integrity occur, and there has been a difficulty in addressing the above-listed problems through proper combinations of materials included in the filler.

Thus, in order to prevent deterioration of the taste of tobacco smoke, deterioration of ash integrity, and extinguishing of the smoking product, while reducing the sidestream smoke, a filler in which magnesium oxide (MgO and/or $Mg(OH)_2$) and calcium carbonate ($CaCO_3$) are mixed is applied to the smoking material wrapper 120*a* according to embodiments of the disclosure. The filler may have a weight ratio of about 20% to about 40% (preferably, 30%) with respect to the total weight of the smoking material wrapper 120*a*, and a weight ratio of magnesium oxide and calcium carbonate which are included in the filler may be about 1:5.5 to about 2.5:1. For example, with respect to the total weight of the smoking material wrapper 120*a*, the magnesium oxide may have a weight ratio of about 5% to about 25%, and the calcium carbonate may have a weight ratio of about 5% to about 25%.

Further, when a basis weight of the smoking material wrapper 120*a* is about 35 $g/m^2$ to about 65 $g/m^2$, preferably, 50 $g/m^2$ to 60 $g/m^2$, while the filler is applied to the smoking material wrapper 120*a*, it is possible to maximize the effect of reducing the sidestream smoke while addressing the above-listed problems. In this case, the smoking material wrapper 120*a* may have a porosity of about 3 CU to about 10 CU (preferably, 5 CU).

Meanwhile, in order to reduce the sidestream smoke, the smoking material wrapper 120*a* may also have a double-wrapping paper structure. Specifically, the smoking material wrapper 120*a* may include an inner wrapper which comes in contact with the smoking material portion 120 and surrounds the smoking material portion 120 and an outer wrapper which comes in contact with the inner wrapper and surrounds the outside of the inner wrapper.

Here, a basis weight of the inner wrapper may be about 20 $g/m^2$ to about 30 $g/m^2$ (preferably, about 26 $g/m^2$), a weight ratio of the filler with respect to the total weight of the inner wrapper may be about 20% to about 40% (preferably, about 30%), and a porosity of the inner wrapper may be about 40 CU to 50 CU (preferably, about 45 CU).

Here, a basis weight of the outer wrapper may be about 20 $g/m^2$ to about 40 $g/m^2$ (preferably, about 35 $g/m^2$), a weight ratio of the filler with respect to the total weight of the outer wrapper may be about 20% to about 40% (preferably, about 30%), and a porosity of the outer wrapper may be about 40 CU to about 50 CU (preferably, about 45 CU).

The smoking material portion 120 wrapped by the smoking material wrapper 120*a* and the filters 112 and 114 wrapped by the combining wrapper 116 may be wrapped together by the tipping wrapper 130. That is, the tipping wrapper 130 may wrap around at least a portion (for example, a partial downstream region) of the smoking material wrapper 120*a* and an outer boundary of the combining wrapper 116. In other words, at least a portion of the smoking material portion 120 and the filters 112 and 114 may be further wrapped by the tipping wrapper 130 and physically combined.

The tipping wrapper 130 may be manufactured using nonporous wrapping paper not treated to be grease-resistant. In a region of the tipping wrapper 130 overlapping the first filter 112, a first perforation region 112*p* (see FIG. 2) in which a plurality of perforations are formed in a circumferential direction is formed. The tipping wrapper 130 may have, in the first perforation region, a porosity of about 50 CU to about 300 CU, preferably, about 90 CU to about 210 CU. Accordingly, the liquid, which is contained in the first capsule 112*a* and is released to the outside of the first capsule 112*a* when the first capsule 112*a* is crushed by the smoker, may pass through the first wrapper 112*a*, the combining wrapper 116, and the tipping wrapper 130 and be delivered to fingers of the smoker.

In some embodiments, the tipping wrapper 130 may be coated with a sweetener such as sucralose and citric acid. Also, a predetermined material may be added into the tipping wrapper 130. An example of the predetermined material may include silicone, but the disclosure is not limited thereto. For example, silicone has characteristics such heat resistance, which prevents significant changes to silicone due to temperature, oxidation resistance, which prevents oxidation of silicone, resistance to various drugs, water repellency, an electrical insulating property, and the like. However, the tipping wrapper 130 may be coated with any material other than silicone as long as the material has the above-described characteristics.

The tipping wrapper 130 may prevent a phenomenon in which the smoking product filter 110 is combusted. For example, when the smoking material portion 120 is combusted to a portion thereof adjacent to the smoking product filter 110, there is a possibility that the smoking product filter 110 may also be combusted. Even in this case, since the tipping wrapper 130 includes an incombustible material, the phenomenon in which the smoking product filter 110 is combusted may be prevented.

The smoking product 100 may have the form of an elongated rod, and, in the smoking product 100, the first filter 112, the second filter 114, and the smoking material portion 120 may each have various lengths, diameters, and circumferences. However, in some embodiments of the disclosure, by properly designing the lengths of the first filter 112 and the second filter 114 and the positional relationship between the capsule 112*c* and the first and second perforations, a portion of the liquid contained in the capsule 112*c* included in the first filter 112, that is released due to the capsule 112*c* being crushed, is efficiently delivered to fingers of a smoker while the remaining portion of the liquid is efficiently delivered to the smoker's mouth together with the mainstream smoke. This will be described in detail below with reference to FIG. 2.

Figure 2:
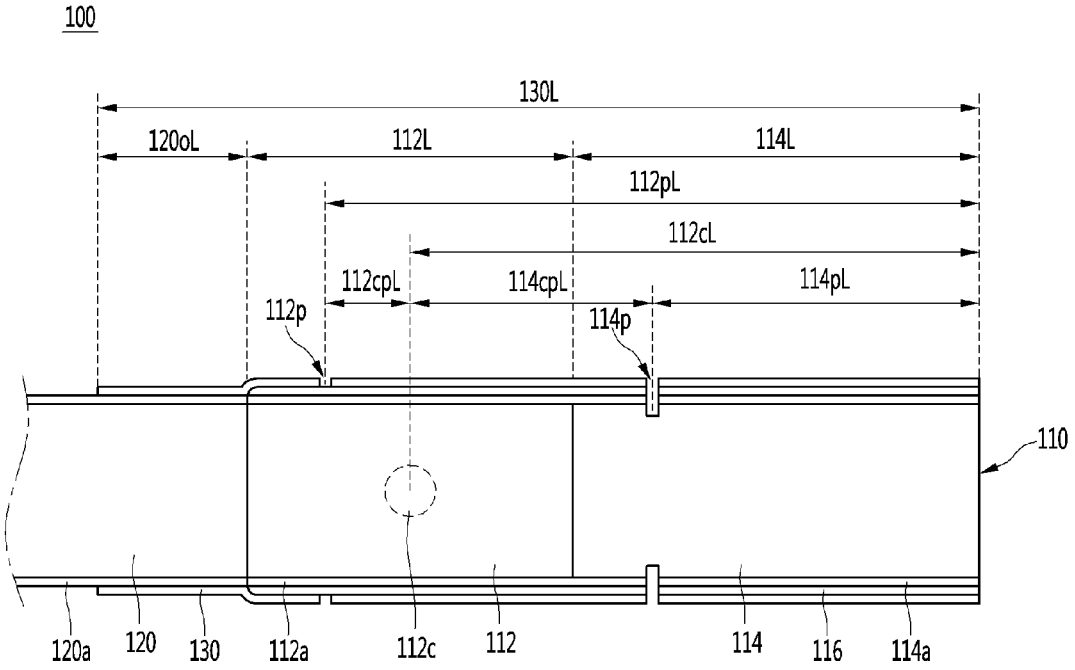
FIG. 2 is a cross-sectional view of a portion of a smoking product in a central axis direction according to some embodiments of the disclosure.

FIG. 2 is a cross-sectional view of a portion of the smoking product in a central axis direction according to some embodiments of the disclosure. In FIG. 2, the same reference numerals as in FIG. 1 represent the same elements, and overlapping descriptions thereof will be omitted to simplify the description.

Referring to FIG. 2, the smoking product 100 may include the smoking material portion 120, the smoking material wrapper 120*a*, the smoking product filter 110, and the tipping wrapper 130, and the smoking product filter 110 may include the first filter 112, the second filter 114, the first wrapper 112*a*, the second wrapper 114*a*, the capsule 112*c*, and the combining wrapper 116.

The smoking product 100 may have a diameter of about 4 mm to about 10 mm, a circumference of about 14 mm to about 29 mm, and a length of about 45 mm to about 100 mm. The smoking material portion 120 may have a length of about 15 mm to about 75 mm.

A length of each of the first filter 112 and the second filter 114 may be properly selected within a range of 4 mm to 30 mm. In some embodiments, the length 112L of the first filter 112 may be less than the length 114L of the second filter 114L. For example, a ratio of the length 112L of the first filter 112 to the length 114L of the second filter 114 may be about 1:1.1 to about 1:1.4 (preferably, 1:1.25). For example, the length 112L of the first filter 112 may be about 11 mm to about 13 mm, and the length 114L of the second filter 114 may be about 14 mm to about 16 mm.

The first perforation region 112*p* in which a plurality of perforations are formed in the circumferential direction is formed in the tipping wrapper 130 disposed at a portion where the first filter 112 is covered, and the second perforation region 114*p* in which a plurality of perforations are formed in the circumferential direction is formed in the wrappers 114*a*, 116, and 130 which are disposed at portions where the second filter 114 is covered. In FIG. 2, the first perforation region 112*p* and the second perforation region 114*p* are exaggerated in size for convenience of description, and the first perforation region 112*p* and the second perforation region 114*p* may also have sizes smaller than those illustrated.

The perforations formed in the first perforation region 112*p* may be formed using an off-line perforation method, i.e., a method in which the smoking product 100 is made by forming perforations in a tipping wrapper in advance before the tipping wrapper is wrapped around the smoking product 100. The off-line perforation may be performed using a laser, but the disclosure is not limited thereto.

The perforations formed in the second perforation region 114*p* may be formed using an on-line perforation method, i.e., a method in which the smoking product 100 is made using a tipping wrapper, which does not have perforations formed in corresponding portions, and then the tipping wrapper is perforated. The on-line perforation may be performed using a laser, but the disclosure is not limited thereto. As the perforations formed in the second perforation region 114*p* are formed by the online-perforation as described above, as illustrated in FIG. 2, the perforations formed in the second perforation region 114*p* may extend not only through the tipping wrapper 130 but also through the combining wrapper 116 and the second wrapper 114*a* and, further, through a partial region of an outer side of the second filter 114. Accordingly, outside air may flow into the second filter 114 from the outside through the second perforation region 114P. The outside air introduced through the second perforations 114P may be mixed with mainstream smoke, which is introduced from an upstream region of the smoking product 100, and delivered to the smoker. For example, the second perforation region 114*p* may include four to ten perforations, and the perforations of the second perforation region 114*p* may be formed to be spaced apart at predetermined intervals along an outer circumferential surface of the tipping wrapper 130, but the disclosure is not limited thereto. A diameter of each hole may be about 0.02 mm to about 0.08 mm (for example, 0.05 mm), but the disclosure is not limited thereto.

Meanwhile, in order to allow a portion of the liquid, that is contained in the capsule 112*c* included in the first filter 112 and is released when the capsule 112*c* is crushed, to be efficiently delivered to fingers of a smoker while allowing the remaining portion of the liquid to be efficiently delivered to the smoker's mouth together with the mainstream smoke via the second filter 114, that is, in order to improve the overall satisfaction before and after smoking by crushing of the capsule 112*c*, the capsule 112*c* may be disposed between the first perforation region 112*p* and the second perforation region 114*p*. That is, the capsule 112*c* may be disposed downstream of the first perforation region 112*p* and upstream of the second perforation region 114*p*.

To this end, the first perforation region 112*p* may be disposed to be spaced about 23 mm to about 27 mm apart (112*p*L) from a downstream end portion of the smoking product 100 in the upstream direction, the second perforation region 114*p* may be disposed to be spaced about 10 mm to about 14 mm apart (114*p*L) from the downstream end portion of the smoking product 100 in the upstream direction, and a central point of the capsule 112*c* may be disposed to be spaced about 19 mm to about 23 mm apart (112*c*L) from the downstream end portion of the smoking product 100 in the upstream direction.

In some embodiments, a separation distance 112*cp*L between the central point of the capsule 112*c* and the first perforation region 112*p* may be less than or equal to a separation distance 114*cp*L between the central point of the capsule 112*c* and the second perforation region 114*p*. More specifically, a ratio of the separation distance 112*cp*L between the central point of the capsule 112*c* and the first perforation region 112*p* to the separation distance 114*cp*L between the central point of the capsule 112*c* and the second perforation region 114*p* may be about 1:2 to about 1:2.5, more preferably, 1:2.25.

A length 130L of the tipping wrapper 130 may be about 30 mm to about 34 mm. In an example case where the length of the smoking product filter 110 is 27 mm, a length 120*o*L of the tipping wrapper 130 overlapping the smoking material portion 120 may be about 3 mm to about 7 mm.

Figure 3:
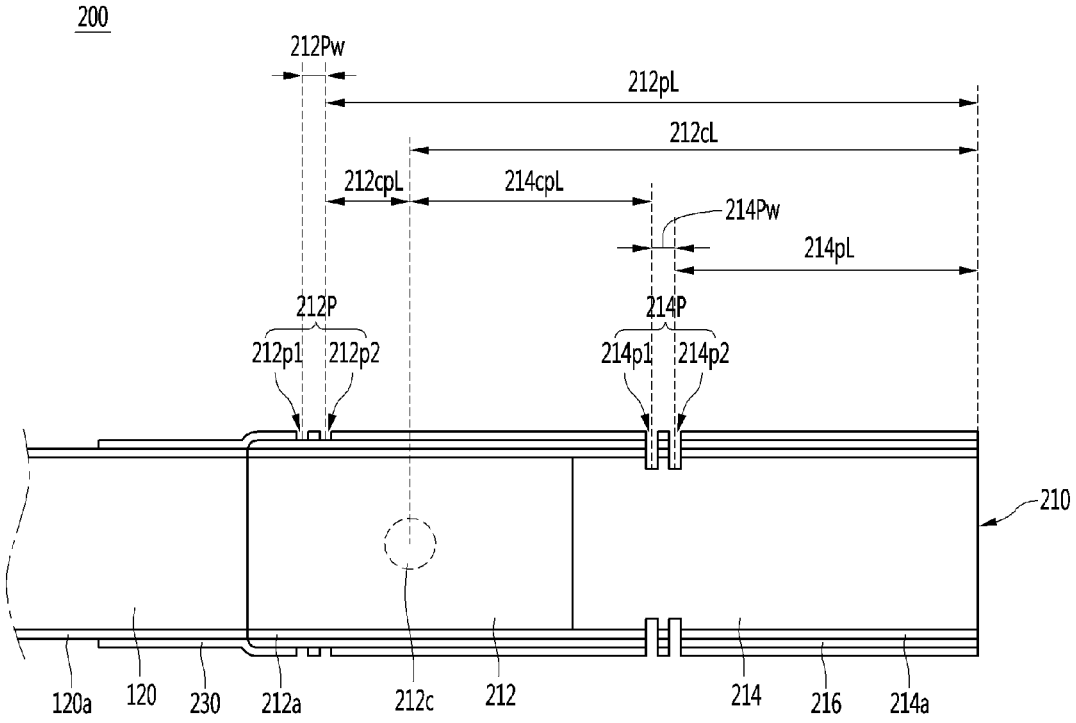
FIG. 3 is a cross-sectional view of a portion of a smoking product in a central axis direction according to some other embodiments of the disclosure.

FIG. 3 is a cross-sectional view of a portion of the smoking product in the central axis direction according to some other embodiments of the disclosure. In FIG. 3, the same reference numerals as in FIGS. 1 and 2 represent the same elements, and overlapping descriptions thereof will be omitted to simplify the description.

Referring to FIG. 3, a smoking product 200 may include a smoking material portion 120, a smoking material wrapper 120*a*, a smoking product filter 210, and a tipping wrapper 230, and the smoking product filter 210 may include a first filter 212, a second filter 214, a first wrapper 212*a*, a second wrapper 214*a*, a capsule 212*c*, and a combining wrapper 216.

Similar to the first perforation region 112*p* and the second perforation region 114*p* which have been described above with reference to FIG. 2, a first perforation region 212*p* in which a plurality of perforations are formed in the circumferential direction is formed in the tipping wrapper 230 disposed at a portion where the first filter 212 is covered, and a second perforation region 214*p* in which a plurality of perforations are formed in the circumferential direction is formed in the wrappers 214*a*, 216, and 230 which are disposed at portions where the second filter 214 is covered. The first perforation region 212*p* may be formed using the off-line perforation method, and the second perforation region 214*p* may be formed using the on-line perforation method.

As illustrated in FIG. 3, double perforations, i.e., first perforations 212*p*1 formed along an outer circumferential surface of the tipping wrapper 230 and second perforations 212*p*2 formed downstream of the first perforations 212*p*1 and along the outer circumferential surface of the tipping wrapper 230, may be formed in the first perforation region 212*p*. A separation distance 212*pw* between the first perforations 212*p*1 and the second perforations 212*p*2 may be about 0.5 mm to about 1.5 mm.

Likewise, third perforations 214*p*1 formed along the outer circumferential surface of the tipping wrapper 230 and fourth perforations 214*p*2 formed downstream of the third perforations 214*p*1 and along the outer circumferential surface of the tipping wrapper 230 may be formed in the second perforation region 214*p*. A separation distance 214*pw* between the third perforations 214*p*1 and the fourth perforations 214*p*2 may be about 0.5 mm to about 1.5 mm.

In some embodiments, the second perforations 212*p*2 may be disposed to be spaced about 22 mm to about 26 mm apart (212*p*L) from a downstream end portion of the smoking product 200 in the upstream direction, and the fourth perforations 214*p*2 may be disposed to be spaced about 9 mm to about 13 mm apart (212*p*L) from the downstream end portion of the smoking product 200 in the upstream direction.

In some embodiments, a separation distance 212*cp*L between a central point of the capsule 212*c* and the second perforations 212*p*2 may be less than or equal to a separation distance 214*cp*L between the central point of the capsule 112*c* and the third perforations 214*p*1. More specifically, a ratio of the separation distance 212*cp*L between the central point of the capsule 212*c* and the second perforations 212*p*2 to the separation distance 214*cp*L between the central point of the capsule 112*c* and the third perforation region 214*p*1 may be about 1:2 to about 1:2.5, more preferably, 1:2.25.

Hereinafter, the configurations of the disclosure and the advantageous effects will be described in more detail using example embodiments and comparative examples. However, the example embodiments are merely for describing the disclosure in more detail, and the scope of the disclosure is not limited by the example embodiments.

Example Embodiment 1

A filter portion of a regular cigarette according to example embodiments were made for testing and were cut and separated. A first filter formed of a cellulose acetate material that was wrapped by a wrapper having a porosity of 30 CU and did not include a capsule and a second filter formed of a cellulose acetate material that was wrapped by a wrapper having a porosity of 30 CU and was a TJNS filter flavored with a flavoring including components listed in Table 10 to be described below were combined using a combining wrapper having a porosity of 30 CU and then were combined with a smoking material portion using a tipping wrapper having a porosity of 100 CU. The amount of the flavoring with which the second filter was flavored was 64 mg, the basis weight of the smoking material portion was 26 g/m$^2$, the smoking material portion included a combustion improver at a weight ratio of 1.5% with respect to the total weight of the smoking material portion, and the smoking material portion was surrounded by a smoking material wrapper having a porosity of 45 CU. In the combustion improver of the smoking material wrapper, a ratio of Na and K citrate was 50:50.

In this case, the tipping wrapper that was used included an off-line perforation region (a first perforation region) formed at a position spaced about 25 mm apart from a downstream end portion of the smoking product in the upstream direction, and, after combination by the tip paper, an on-line perforation region (a second perforation region) was formed, by an on-line perforation, at a position spaced about 12 mm apart from the downstream end portion of the smoking product in the upstream direction. In this way, a smoking product was made.

Example Embodiment 2

Except that a first filter including a capsule at a position spaced about 21 mm apart from the downstream end portion of the smoking product in the upstream direction was used, and, as a second filter wrapper and a combining wrapper, pieces of wrapping paper having a porosity of 24,000 CU were used, a smoking product identical to that of Example Embodiment 1 was made.

Example Embodiment 3

Except that, as the second filter wrapper and the combining wrapper, pieces of wrapping paper having a porosity of 35,000 CU were used, a smoking product identical to that of Example Embodiment 2 was made.

Example Embodiment 4

Except that a first filter including a capsule at a position spaced about 21 mm apart from the downstream end portion of the smoking product in the upstream direction was used, a smoking product identical to that of Example Embodiment 1 was made.

Example Embodiment 5

Except that, as the tipping wrapper, wrapping paper having a porosity of 5 CU was used, a smoking product identical to that of Example Embodiment 4 was made.

Example Embodiment 6

Except that, as the tipping wrapper, wrapping paper having a porosity of 200 CU was used, a smoking product identical to that of Example Embodiment 4 was made.

Comparative Example 1

Except that a second filter formed of a cellulose acetate material without TJNS flavoring was used, a smoking product identical to that of Example Embodiment 1 was made.

Experimental Example 1: Analysis of Physical Characteristics of Cigarettes According to Example Embodiments 1 to 6 and Comparative Example 1

A dilution rate and draw resistance during smoking were analyzed to determine whether deterioration of physical characteristics of cigarettes occurs when the filters and wrappers according to the example embodiments of the disclosure were applied.

Table 1 shows specifications of smoking products according to Example Embodiments 1 to 6 and Comparative Example 1, and Table 2 shows results of analyzing physical characteristics of cigarettes by using the smoking products according to Example Embodiments 1 to 6 and Comparative Example 1. In Table 2, "UPD(uncapsulated)" indicates results of testing the draw resistance while all perforations of the smoking product were open, and "EPD(encapsulated)" indicates results of testing the draw resistance while all the perforations of the smoking product were blocked. In all of Example Embodiments 2 to 6 in which a capsule was included, the capsule was crushed.

TABLE 1

| Classification | Porosity of second wrapper/combining wrapper (CU) | Porosity of tipping wrapper (CU) | TJNS filter | Capsule |
|---|---|---|---|---|
| Comparative Example 1 | 30/30 | 100 | x | x |
| Example Embodiment 1 | 30/30 | 100 | ○ | x |
| Example Embodiment 2 | 24,000/24,000 | 100 | ○ | ○ |
| Example Embodiment 3 | 35,000/35,000 | 100 | ○ | ○ |
| Example Embodiment 4 | 30/30 | 100 | ○ | ○ |
| Example Embodiment 5 | 30/30 | 5 | ○ | ○ |
| Example Embodiment 6 | 30/30 | 200 | ○ | ○ |

TABLE 2

| Classification | Dilution rate (%) | UPD ($mmH_2O$) | EPD ($mmH_2O$) |
|---|---|---|---|
| Comparative Example 1 | 83.8 | 57 | 155 |
| Example Embodiment 1 | 83.4 | 59 | 157 |
| Example Embodiment 2 | 83.8 | 60 | 159 |
| Example Embodiment 3 | 84.2 | 59 | 159 |
| Example Embodiment 4 | 83.9 | 59 | 161 |
| Example Embodiment 5 | 83.8 | 58 | 159 |
| Example Embodiment 6 | 84.2 | 57 | 159 |

As shown in Table 2, there were no significant changes in the physical characteristics of the cigarettes, regardless of different porosities of the second wrapper, the combining wrapper, and the tipping wrapper used, whether a TJNS filter was adopted, and whether a capsule was included. That is, it was seen that the physical characteristics of the cigarettes did not deteriorate even when the specifications according to the example embodiments of the disclosure were applied.

Experimental Example 2: Analysis of Components of Mainstream Smoke of Cigarettes According to Example Embodiments 1 to 6 and Comparative Example 6

Components of mainstream smoke were analyzed to measure the effect of reducing bad breath by the cigarettes according to the example embodiments of the disclosure.

Table 3 shows results of analyzing components of mainstream smoke of the smoking products according to Example Embodiments 1 to 6 and Comparative Example 1, whose specifications are shown in Table 1 above. The components of the mainstream smoke generated while a smoker smoked the smoking products are shown in Table 3 below, and from this, the extent to which a tobacco smell from the smoker's mouth is reduced can be inferred. In all of Example Embodiments 2 to 6 in which a capsule was included, the capsule was crushed.

TABLE 3

| Classification | Porosity of second wrapper/combining wrapper (CU) | Porosity of tipping wrapper (CU) | Tar (mg/cig) | Nicotine (mg/cig) | Menthol (mg/cig) |
|---|---|---|---|---|---|
| Comparative Example 1 | 30/30 | 100 | 0.91 | 0.08 | 0.00 |
| Example Embodiment 1 | 30/30 | 100 | 0.95 | 0.07 | 0.01 |
| Example Embodiment 2 | 24,000/24,000 | 100 | 1.59 | 0.10 | 0.25 |
| Example Embodiment 3 | 35,000/35,000 | 100 | 1.52 | 0.10 | 0.26 |
| Example Embodiment 4 | 30/30 | 100 | 1.60 | 0.10 | 0.28 |
| Example Embodiment 5 | 30/30 | 5 | 1.70 | 0.11 | 0.30 |
| Example Embodiment 6 | 30/30 | 200 | 1.44 | 0.09 | 0.27 |

As a result of analyzing the components of the mainstream smoke, an increase in a tar value was confirmed in all of Example Embodiments 1 to 6 as compared with Comparative Example 1, but this corresponds to an increment in the content of menthol and other oil-like flavoring agents in the TJNS filter and/or the capsule. Regarding the components of the mainstream smoke of the cigarettes according to Example Embodiments 4 to 6 in which, in terms of porosity, only the porosity of the tipping wrapper differed, it was identified that, as a porosity of secondary perforations of the tipping wrapper increased, transfer amounts of tar, nicotine, and menthol tended to decrease. That is, it was seen that the effect of reducing a tobacco smell from the smoker's mouth was greater as the porosity of the tipping wrapper increased within the range of 5 CU to 200 CU.

Experimental Example 3: Analysis of Menthol Content in Sidestream Smoke in First Perforation Region To measure the effect of reducing a smell on fingers when smoking the cigarettes according to the example embodiments of the disclosure, changes in the content of menthol in the sidestream smoke in a first perforation region were analyzed.

All the smoking products were smoked in an imbalanced state. Smoking conditions were set as follows: a puff volume of 55 ml, a puff time of 2 seconds, a puff cycle of 20 seconds, and a puff number of 12. For measuring components of smoke, smoke collected by wrapping the Cambridge filter pad (CFP) around tipping wrappers 130 and 230 in which the first filter 112 was disposed was analyzed using gas chromatography (GC).

TABLE 4

| Classification | Porosity of second wrapper/combining wrapper (CU) | Porosity of tipping wrapper (CU) | TJNS filter | Capsule | Menthol content (ug/cig) |
|---|---|---|---|---|---|
| Comparative Example 1 | 30/30 | 100 | x | x | 0.00 |
| Example Embodiment 1 | 30/30 | 100 | ○ | x | 0.31 |
| Example Embodiment 2 | 24,000/24,000 | 100 | ○ | ○ | 36.45 |
| Example Embodiment 3 | 35,000/35,000 | 100 | ○ | ○ | 45.60 |
| Example Embodiment 4 | 30/30 | 100 | ○ | ○ | 30.27 |
| Example Embodiment 5 | 30/30 | 5 | ○ | ○ | 26.31 |
| Example Embodiment 6 | 30/30 | 200 | ○ | ○ | 35.51 |

Referring to the analysis results of Example Embodiment 1 and Comparative Example 1, it can be seen that menthol was released into the first perforation region in accordance with application of the TJNS filter. Referring to the analysis results of Example Embodiment 1, Example Embodiment 4, and Comparative Example 1, it can be seen that the content of menthol released into the first perforation region significantly increased in accordance with application of a capsule and crushing the capsule rather than application of the TJNS filter.

Referring to the analysis results of Example Embodiments 2 to 4 and Comparative Example 1, it can be seen that the content of menthol released into the first perforation region increased in accordance with an increase in the porosities of the second wrapper and the combining wrapper.

Referring to the analysis results of Example Embodiments 4 to 6 and Comparative Example 1, it can be seen that the content of menthol released into the first perforation region increased in accordance with an increase in the porosity of the secondary perforations of the tipping wrapper.

That is, the content of menthol released into the first perforation region tended to increase when both the TJNS filter and the capsule were applied and the second wrapper, the combining wrapper, and the tipping wrapper each having a high porosity were applied.

Taking into consideration the importance of the amount of menthol delivered in masking the tobacco smell, it was predicted that, among the example embodiments, the effect of reducing a smell on fingers due to smoking would be the greatest in Example Embodiment 3 in which the second wrapper and the combining wrapper each having a porosity of 35,000 CU were applied and the tipping wrapper having a porosity of 100 CU was applied.

Experimental Example 4: Sensory Evaluation on Effect of Reducing Smell on Fingers According to Example Embodiments 1 to 6 and Comparative Example 1

To examine the effect of reducing a smell on fingers by the smoking products according to Example Embodiments 1 to 6 and Comparative Example 1, a sensory evaluation was performed on the extent of a tobacco smell on fingers after smoking, the extent of a scent other than the tobacco smell remaining on the fingers, and satisfaction with the scent other than the tobacco smell remaining on the fingers.

The sensory evaluation was performed by a panel of ten evaluators using the smoking products of Example Embodiments 1 to 6 and Comparative Example 1, based on a maximum of 8 points.

Figure 4:
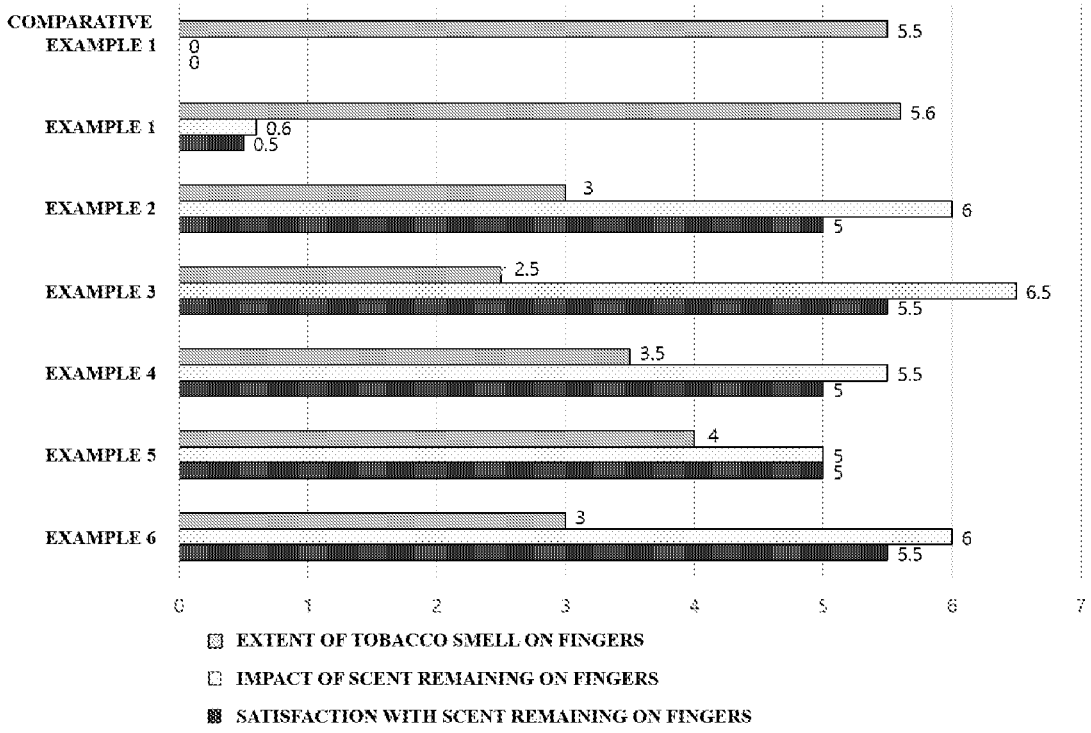
FIG. 4 shows results of sensory evaluations after smoking according to Example Embodiments 1 to 6 and Comparative Example 1.

FIG. 4 shows results of sensory evaluations after smoking according to Example Embodiments 1 to 6 and Comparative Example 1.

As shown in FIG. 4, it was seen that, in all of Example embodiments 2 to 6 in which both the TJNS filter and the capsule were applied, the extent of the tobacco smell on the fingers after smoking decreased to a significant extent while the scent other than the tobacco smell was sensed from the fingers after smoking. It was seen that, in Example Embodiment 1 in which only the TJNS filter was applied, the impact of the scent remaining on the fingers and the satisfaction with the scent slightly increased as compared with Comparative Example 1, but there was no effect of reducing the tobacco smell on the fingers after smoking.

The effect of reducing the tobacco smell on the fingers after smoking was found to be the greatest in Example Embodiment 3 in which the second wrapper and the combining wrapper each having a high porosity (35,000 CU) were used. The effect was found to be the next greatest in Example Embodiment 2 in which the second wrapper and the combining wrapper each having a porosity of 24,000 CU were used and Example Embodiment 6 in which, although the porosities of the second wrapper and the combining wrapper were low (30 CU), the porosity of the tipping wrapper was high (200 CU).

Referring to FIG. 4 and Table 4 together, it is determined that the results of the sensory evaluation after smoking which are shown in FIG. 4 are overall highly correlated with the content of menthol in the sidestream smoke that is shown in Table 4. From this, it can be seen that the tobacco smell remaining on the fingers of the smoker was effectively masked as menthol released into the first perforation region was delivered to the fingers of the smoker.

Example Embodiment 7, Example Embodiment 8, Example Embodiment 9

Except for positions of first and second perforations and a position of the center of the capsule which are presented in Table 5 below, a smoking product identical to that of Example Embodiment 10 below was made.

Example Embodiment 10

A smoking product identical to Example Embodiment 3 was made.

Example Embodiment 11

Except for the positions of the first and second perforations and the position of the center of the capsule which are presented in Table 5 below, a smoking product identical to that of Example Embodiment 10 was made.

TABLE 5

| Classification | Position of first perforations (mm) | Position of center of capsule (mm) | Position of second perforations (mm) |
|---|---|---|---|
| Comparative Example 2 | 12 | 15 | Non-perforated |
| Example Embodiment 7 | 12 | 15 | 22.5 |
| Example Embodiment 8 | 12 | 24 | 24 |

TABLE 5-continued

| Classification | Position of first perforations (mm) | Position of center of capsule (mm) | Position of second perforations (mm) |
|---|---|---|---|
| Example Embodiment 9 | 12 | 24 | 20 |
| Example Embodiment 10 | 12 | 21 | 25 |
| Example Embodiment 11 | 12 | 12 | 25 |

Experimental Example 5: Sensory Evaluations During Smoking/after Smoking According to Example Embodiments 7 to 11 and Comparative Example 2

A sensory evaluation was performed on satisfaction during smoking, the extent of a tobacco smell on fingers after smoking, and the extent of a scent other than the tobacco smell remaining on the fingers after smoking, according to the arrangement relationship among a capsule, a first perforation region, and a second perforation region.

The sensory evaluation was performed by a panel of ten evaluators using the smoking products of Example Embodiments 7 to 11 and Comparative Example 2, based on a maximum of 8 points.

Figure 5:
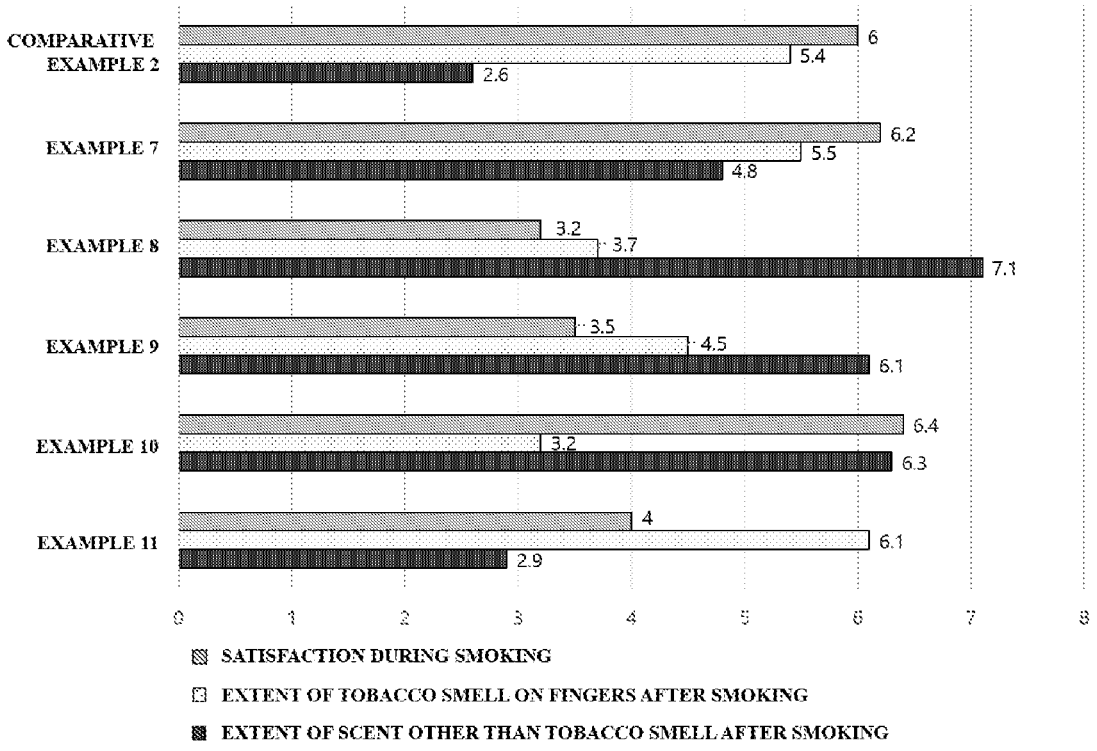
FIG. 5 shows results of sensory evaluations during smoking and after smoking according to Example Embodiments 7 to 11 and Comparative Example 2.

FIG. 5 shows results of sensory evaluations during smoking and after smoking according to Example Embodiments 7 to 11 and Comparative Example 2.

As shown in FIG. 5, in the majority of the example embodiments in which the second perforations were applied, the extent of the tobacco smell on the fingers after smoking tended to decrease and the extent of the scent other than the tobacco smell after smoking tended to increase, as compared with Comparative Example 2 in which the second perforations were not formed. However, the effect of reducing the tobacco smell on the fingers was substantially not found in Example Embodiment 7, in which the capsule was about 15 mm apart and the second perforations were about 22.5 mm apart from the downstream end portion of the smoking product, and Example Embodiment 11, in which the capsule was about 12 mm apart and the second perforations were about 25 mm apart from the downstream end portion of the smoking product.

Meanwhile, in Example Embodiment 7 in which the capsule and the second perforations were about 24 mm apart from the downstream end portion of the smoking product, it was found that the extent of the scent other than the tobacco smell after smoking was the highest and the effect of reducing the tobacco smell on the fingers was also great, but the satisfaction during smoking was found to be lower as compared with other example embodiments. This may be due to the liquid in the capsule, that is released to the outside due to crushing the capsule, not being delivered evenly to the smoker's fingers and mouth. That is, it seems that the single capsule included in the filter thoroughly performed the function of reducing the tobacco smell on the fingers, but delivery of a flavoring for improving satisfaction of smoking by the capsule was somewhat weakened.

In Example Embodiment 10 in which the capsule was about 21 mm apart and the second perforations were about 22.5 mm apart from the downstream end portion of the smoking product, a decrease in the extent of the tobacco smell on the fingers after smoking was the highest, the extent of the scent other than the tobacco smell was the second highest after Example 8, and a score indicating the satisfaction during smoking was also the highest. Thus, the satisfaction before and after smoking was found to be the highest in Example Embodiment 10.

Comparative Example 3

A smoking product identical to that of Example Embodiment 2 was made.

Example Embodiments 12 to 15

Except for porosities of smoking material wrappers and compositions of fillers which are presented in Table 6 below, smoking products identical to that of Comparative Example 3 were made.

Experimental Example 6: Analysis of Sidestream Smoke According to Example Embodiments 12 to 15 and Comparative Example 3

To measure the effect of reducing the sidestream smoke when smoking the cigarettes according to Example Embodiments 12 to 15, total particulate matter (TPM) and major components of the sidestream smoke were analyzed.

All the smoking products were smoked in an imbalanced state. Smoking conditions were set as follows: a puff volume of 55 ml, a puff time of 2 seconds, a puff cycle of 20 seconds, and a puff number of 12. For measuring components of smoke, smoke collected by wrapping the CFP around tipping wrappers in which the first filter was disposed was analyzed using GC. Table 6 shows the TPM content in the sidestream smoke in each example, and Table 7 shows contents of major components that cause an unpleasant sidestream smoke smell in each example.

TABLE 6

| Classification | Porosity of cigarette paper (CU) | Filler (%) Mg(OH)2 | Filler (%) CaCO3 | TPM in sidestream smoke (mg/cig) | Sidestream smoke reduction rate (%) |
|---|---|---|---|---|---|
| Comparative Example 3 | 45 | 0 | 30 | 32.08 | — |
| Example Embodiment 12 | 5 | 5 | 25 | 26.52 | 17.3 |
| Example Embodiment 13 | 5 | 10 | 20 | 22.37 | 30.3 |
| Example Embodiment 14 | 5 | 20 | 10 | 20.27 | 36.8 |
| Example Embodiment 15 | 5 | 30 | 0 | 24.49 | 23.0 |

In all the example embodiments, the TPM content in the sidestream smoke was found to be decreased as compared with Comparative Example 3. The effect of reducing the sidestream smoke was found to be the greatest in Example Embodiment 13 and Example Embodiment 14 in which a ratio of magnesium hydroxide and calcium carbonate was about 1:2 to about 2:1. This may be due to the result of proper development of a specific surface area on a surface of a filler in which magnesium hydroxide and calcium carbonate were mixed with the above ratio, according to a temperature rise of cigarette paper during smoking. Referring to the analysis results of Example Embodiment 12 to Example Embodiment 15, it can be seen that the effect of reducing the sidestream smoke increased as the content of magnesium hydroxide applied to the cigarette paper increased. However, it can be seen that the effect of reducing the sidestream smoke rather decreased when a filler which only included magnesium hydroxide, without a mixture of magnesium hydroxide and calcium carbonate, was used (Example Embodiment 15). This may be due to the result of deterioration of ash integrity during smoking.

TABLE 7

| Classification | Pyridine (ug/cig.) | 3-Ethyl pyridine (ug/cig.) | 3-Ethenyl pyridine (ug/cig.) | Nicotine (ug/cig.) |
|---|---|---|---|---|
| Comparative Example 3 | 0 | 0.87 | 20.6 | 2562.1 |
| Example Embodiment 12 | 0 | 0.81 | 18.3 | 2354.7 |
| Example Embodiment 13 | 0 | 0.41 | 11.1 | 1883.1 |
| Example Embodiment 14 | 0 | 0.37 | 12.5 | 1815.3 |
| Example Embodiment 15 | 0 | 0.66 | 16.7 | 2248.6 |

As shown in Table 7, it was confirmed that the contents of nicotine, 3-ethyl pyridine, and 3-ethenyl pyridine, which are major components causing an unpleasant sidestream smoke smell, decreased (the value of pyridine measured was the limit of quantitation (LOQ) and thus was not taken into consideration) in all of the example embodiments, and the effect of decreasing the contents was great particularly in Example Embodiments 13 and 14.

Comparative Example 4

A smoking product identical to that of Comparative Example 3 was made.

Example Embodiments 16 to 22

Except for porosities and basis weights of smoking material wrappers and whether a double wrapper was applied to the smoking material wrappers, which are presented in Table 8 below, smoking products identical to that of Comparative Example 3 were made.

Experimental Example 7: Analysis of Sidestream Smoke According to Example Embodiments 16 to 22 and Comparative Example 4

To measure the effect of reducing the sidestream smoke when smoking the cigarettes according to Example Embodiments 16 to 22, the TPM content in the sidestream smoke was analyzed under the same smoking conditions as in Experimental Example 6.

TABLE 8

| Classification | Inner wrapper Basis weight ($g/m^2$)/ $CaCO_3$(%) | Inner wrapper Porosity (CU) | Outer wrapper Basis weight ($g/m^2$)/ $CaCO_3$(%) | Outer wrapper Porosity (CU) | TPM in sidestream smoke (mg/cig) | Sidestream smoke reduction rate (%) |
|---|---|---|---|---|---|---|
| Comparative Example 4 | — | — | 26/30 | 45 | 32.08 | — |
| Example Embodiment 16 | — | — | 40/30 | 5 | 27.35 | 14.7 |
| Example Embodiment 17 | — | — | 40/40 | 5 | 25.12 | 21.7 |
| Example Embodiment 18 | — | — | 50/40 | 5 | 23.75 | 26.0 |
| Example Embodiment 19 | — | — | 60/40 | 5 | 21.51 | 32.9 |
| Example Embodiment 20 | 10/0 | 5 | 26/30 | 45 | 20.68 | 35.5 |
| Example Embodiment 21 | 26/30 | 45 | 26/30 | 45 | 22.65 | 29.4 |
| Example Embodiment 22 | 26/30 | 45 | 35/30 | 45 | 19.58 | 39.0 |

Referring to the analysis results of Example Embodiments 16 to 19 in which a single wrapper was applied as the cigarette paper, as the basis weight of the cigarette paper increased, or as the content of a calcium carbonate filler increased, the TPM content in the sidestream smoke tended to decrease. Referring to the analysis results of Example Embodiments 20 to 22 in which a double wrapper was applied, the effect of reducing the sidestream smoke was found to be great in all of the example embodiments in which the double wrapper was applied, as compared with the example embodiments in which the single wrapper was applied. However, in Example Embodiment 20 in which an inner wrapper whose basis weight was 10 $g/m^2$ and porosity was 5 CU and which did not contain a filler was applied, the extent of the effect of reducing the sidestream smoke was similar to Example Embodiments 21 and 22, but there were problems in that ash blew excessively during smoking and the cigarette was extinguished while not being smoked. In Example Embodiments 21 and 22 in which the inner wrapper also contained the filler, the problems such as excessive ash blowing or the cigarette being extinguished did not occur while the effect of reducing the sidestream smoke was great.

Experimental Example 8: Collection of Breath Samples and Analysis of Breath Samples According to Example Embodiments 23 and 24 and Comparative Example 5

To measure the effect of reducing bad breath, breath samples were collected and analyzed for each example. In Example Embodiment 23 and Example Embodiment 24, smoking products identical to Example Embodiment 1 and Example Embodiment 3 were made, respectively. In Comparative Example 5, a smoking product identical to Comparative Example 1 was made.

Breath samples were collected from a total of ten smokers, five times for each example at an interval of thirty minutes. The breath samples were collected after each smoker kept his or her mouth shut for two minutes after smoking a single cigarette. The collected smoke was sampled in a 3 L-Tedlar bag and analyzed using thermal desorber (TD)/GC-pulsed flame photometric detector (PFPD).

The analysis was performed on methyl mercaptan (MM), di-methyl sulfide (DMS), hydrogen sulfide (H2S), and di-methyl di-sulfide (DMDS). However, H2S and DMDS were omitted from Table 12 below due to being detected in concentrations at levels lower than a threshold, thus causing difficulty in deriving statistically significant results.

Results of measuring a threshold index (TI) of MM (or methanethiol) and DMS for each example are presented in Table 9.

TABLE 9

| Classification | TJNS filter | TJNS Capsule | Porosity of TE wrapping paper (CU)/ Porosity of combining wrapping paper (CU) | Porosity of tip paper (CU) | Bad breath-causing components (TI) MM | Bad breath-causing components (TI) DMS |
|---|---|---|---|---|---|---|
| Comparative Example 5 | x | x | 30/30 | 100 | 3.3 | 1.6 |
| Example Embodiment 23 | ○ | x | 30/30 | 100 | 2.6 | 1.4 |
| Example Embodiment 24 | ○ | ○ | 35,000/35,000 | 100 | 2.0 | 1.2 |

As shown in Table 9, numerical values of the TI of methyl mercaptan and dimethyl sulfide were relatively lower in Example 23 in which the TJNS filter was applied, as compared with Comparative Example 5. The effect of decreasing the numerical values of the TI of methyl mercaptan and dimethyl sulfide was found to be greater in Example Embodiment 24 in which both the TJNS filter and the capsule were applied, as compared with Example Embodiment 23.

Experimental Example 9: Sensory Evaluation after Smoking According to Example Embodiments 23 and 24 and Comparative Example 5

The sensory evaluation was performed by a panel of ten evaluators using the smoking products of Example Embodiments 23 and 24 and Comparative Example 5, based on a maximum of 8 points.

Figure 6:
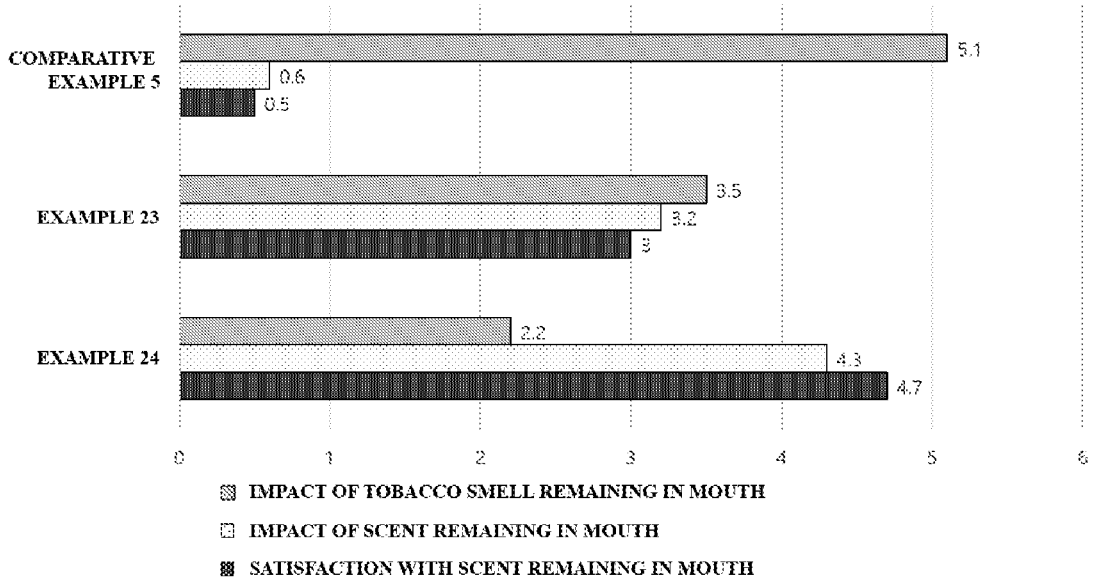
FIG. 6 shows results of sensory evaluations after smoking according to Example Embodiments 23 and 24 and Comparative Example 5.

FIG. 6 shows results of sensory evaluations after smoking according to Example Embodiments 23 and 24 and Comparative Example 5. As shown in FIG. 6, in Example Embodiment 23 in which the TJNS filter was applied, the impact of a tobacco smell remaining in the mouth was reduced, and the impact of a scent, other than the tobacco smell, remaining in the mouth and satisfaction with the scent were increased, as compared with Comparative Example 5. In Example 24 Embodiment in which both the TJNS filter and the capsule were applied, the effect of reducing bad breath was found to be greater as compared with Example Embodiment 23.

Meanwhile, through experiments of varying combinations of components included in a flavoring liquid, it was found that the effect of reducing bad breath by reducing the contents of methyl mercaptan and/or dimethyl sulfide vary according to the type of TINS flavoring liquid and the type of capsule flavoring liquid. Tables 10 to 13 below show components included in the TINS flavoring liquid and the capsule flavoring liquid that were confirmed as maximizing the effect of reducing bad breath.

Specifically, Table 10 shows components of a first TINS flavoring liquid according to a preferred embodiment of the disclosure, and Table 11 shows components of a second TINS flavoring liquid according to a preferred embodiment of the disclosure. Table 12 shows components of a first capsule flavoring liquid according to a preferred embodiment of the disclosure, and Table 13 shows components of a second capsule flavoring liquid according to a preferred embodiment of the disclosure.

TABLE 10

| Classification | Component ratio (order) |
|---|---|
| MCTG | 1 |
| MENTHOL | 2 |
| CIS-3-HEXENOL | 3 |
| LINALOOL [3,7-DIMETHYL-1,6-OCTADIEN-3-OL] | 4 |
| EUCALYPTOL | 5 |
| METHYL SALICYLATE [BENZOIC ACID, 2-HYDROXY-, METHYL ESTER] | 6 |
| GUAIACOL [0-METHOXYPHENOL] | 7 |
| ANISE STAR OIL | 8 |
| PEPPERMINT OIL | 9 |
| LEMON OIL | 10 |
| ORANGE OIL | 11 |
| SPEARMINT OIL | 12 |
| LIME OIL | 13 |
| GINGER OIL PREMIUM | 14 |

As shown in Table 10, the first TJNS flavoring liquid may have a component ratio in which, except for the solvent (MCTG), menthol, cis-3-hexenol, linalool, and eucalyptol are contained in progressively decreasing amounts in that order. In the first TJNS flavoring liquid, a ratio of the content of menthol and the content of cis-3-hexenol may be about 40:1 to about 50:1, and a ratio of the content of cis-3-hexenol and the content of linalool may be about 1.5:1 to about 1.6:1.

TABLE 11

| Classification | Component ratio (order) |
|---|---|
| MCTG | 1 |
| MENTHOL | 2 |
| CIS-3-HEXENOL | 3 |
| HEXANAL [ALDEHYDE C-6 OR CAPROIC ALDEHYDE] | 4 |
| EUCALYPTOL [1,8-CINEOLE] | 5 |
| METHYL SALICYLATE [BENZOIC ACID, 2-HYDROXY-, METHYL ESTER] | 6 |
| GUAIACOL [0-METHOXYPHENOL] | 7 |
| PEPPERMINT OIL | 8 |

TABLE 11-continued

| Classification | Component ratio (order) |
|---|---|
| ANISE STAR OIL | 9 |
| SPEARMINT OIL | 10 |
| LIME OIL | 11 |
| GINGER OIL PREMIUM | 12 |

As shown in Table 11, the second TJNS flavoring liquid may have a component ratio in which, except for the solvent, menthol, cis-3-hexenol, hexanal, and eucalyptol are contained in progressively decreasing amounts in that order. In the second TJNS flavoring liquid, a ratio of the content of menthol and the content of cis-3-hexenol may be about 35:1 to about 45:1, and a ratio of the content of cis-3-hexenol and the content of hexanal may be about 2:1 to about 3:1.

TABLE 12

| Classification | Component ratio (order) |
|---|---|
| MCTG | 1 |
| MENTHOL | 2 |
| LIME OIL | 3 |
| METHYL SALICYLATE | 4 |
| PEPPERMINT OIL | 5 |
| ROSEMARY OIL | 6 |
| GUAIACOL [0-METHOXYPHENOL] | 7 |
| SPEARMINT OIL | 8 |
| ANISE STAR OIL | 9 |
| SAGE OIL | 10 |

As shown in Table 12, the first capsule flavoring liquid may have a component ratio in which, except for the solvent, menthol, lime oil, methyl salicylate, and peppermint oil are contained in progressively decreasing amounts in that order. In the first capsule flavoring liquid, a ratio of the content of menthol and the content of lime oil may be about 10:1 to about 15:1, and a ratio of the content of lime oil and the content of methyl salicylate may be about 1.1:1 to about 1.3:1.

TABLE 13

| Classification | Component ratio (order) |
|---|---|
| MCTG | 1 |
| MENTHOL | 2 |
| ORANGE OIL | 3 |
| CIS-3-HEXENOL | 4 |
| LEMON OIL | 5 |
| LINALOOL [3,7-DIMETHYL-1,6-OCTADIEN-3-OL] | 6 |
| LIME OIL | 7 |
| PEPPERMINT OIL | 8 |
| CITRONELLOL [3,7-DIMETHYL-6-OCTENOL] | 9 |
| CITRAL [3,7-DIMETHYL-2,6-OCTADIENAL] | 10 |
| GAMMA-NONALACTONE [NONANO-1,4-LACTONE/ALDEHYDE C-18] | 11 |

As shown in Table 13, the second capsule flavoring liquid may have a component ratio in which, except for the solvent, menthol, orange oil, cis-3-hexenol, and lemon oil are contained in progressively decreasing amounts in that order. In the second capsule flavoring liquid, a ratio of the content of menthol and the content of orange oil may be about 5:1 to about 6:1, and a ratio of the content of orange oil and the content of cis-3-hexenol may be about 7:1 to about 8:1. Those of ordinary skill in the art related to the present example embodiments should understand that the disclosure may be implemented in modified forms within the scope not departing from essential characteristics of the above description. Therefore, the methods disclosed herein should be considered as illustrative rather than limiting. The scope of the disclosure is defined by the claims below rather than by the above description, and all differences within the scope equivalent to the claims should be interpreted as falling within the scope of the disclosure.

What is claimed is:

1. A smoking product comprising:

a smoking material portion which is wrapped by a smoking material wrapper;

a filter portion having an upstream end portion which is combined with the smoking material portion, the filter portion including a capsule containing a flavoring, and being wrapped by a filter wrapper; and a tipping wrapper which surrounds at least a partial region of the smoking material portion and the filter portion so that the smoking material portion and the filter portion are combined, wherein the tipping wrapper includes a first perforation region, the first perforation region including a plurality of perforations formed along an outer circumferential surface of the tipping wrapper, and a second perforation region, the second perforation region including a plurality of perforations formed downstream of the first perforation region and along the outer circumferential surface of the tipping wrapper, the capsule is disposed downstream of the first perforation region and upstream of the second perforation region, the filter portion includes a first filter having an upstream end portion which is combined with the smoking material portion and which includes the capsule and a second filter whose upstream end portion is combined with a downstream end portion of the first filter;

the filter wrapper includes a first wrapper which surrounds the first filter, a second wrapper which surrounds the second filter, and a combining wrapper which surrounds the first filter and the second filter so that the first filter and the second filter are combined, the first perforation region is disposed in a region overlapping the first filter, and the second perforation region is disposed in a region overlapping the second filter, and the first perforation region is formed to pass through the tipping wrapper but not pass through the combining wrapper and the first wrapper, and the second perforation region is formed to pass through the tipping wrapper, the combining wrapper, and the second wrapper.

2. The smoking product of claim 1, wherein an axial length of the first filter is less than an axial length of the second filter.

3. The smoking product of claim 2, wherein a ratio of the axial length of the first filter to the axial length of the second filter is 1:1.1 to 1:1.4.

4. The smoking product of claim 2, wherein the axial length of the first filter is 11 mm to 13 mm, and the axial length of the second filter is 14 mm to 16 mm.

5. The smoking product of claim 1, wherein the first perforation region is disposed to be spaced 23 mm to 27 mm apart from a downstream end portion of the smoking product in an upstream direction, the second perforation region is disposed to be spaced 10 mm to 14 mm apart from the downstream end portion of the smoking product in the upstream direction, and a central point of the capsule is disposed to be spaced 19 mm to 23 mm apart from the downstream end portion of the smoking product in the upstream direction.

6. He smoking product of claim 1, wherein a separation distance between a central point of the capsule and the first perforation region is less than or equal to a separation distance between the central point of the capsule and the second perforation region.

7. The smoking product of claim 6, wherein a ratio of the separation distance between the central point of the capsule and the first perforation region to the separation distance between the central point of the capsule and the second perforation region is 1:2 to 1:2.5.

8. The smoking product of claim 1, wherein a porosity of each of a first wrapper and a combining wrapper is 23,000 CU or higher, a porosity of a second wrapper is 10 CU to 50 CU, and a porosity in the first perforation region of the tipping wrapper is 90 CU to 210 CU.

9. The smoking product of claim 1, wherein a filler in which magnesium oxide and calcium carbonate are mixed is applied to the smoking material wrapper, and the filler has a weight ratio of 20% to 40% with respect to a total weight of the smoking material wrapper.

10. The smoking product of claim 9, wherein a weight ratio of the magnesium oxide to the calcium carbonate which are included in the filler is 1:5.5 to 2.5:1.

11. The smoking product of claim 9, wherein, with respect to the total weight of the smoking material wrapper, the magnesium oxide has a weight ratio of 5% to 25%, and the calcium carbonate has a weight ratio of about 5% to about 25%.

12. The smoking product of claim 9, wherein a basis weight of the smoking material wrapper is 35 $g/m^2$ to 65 $g/m^2$, and a porosity of the smoking material wrapper is 3 CU to 10 CU.

13. The smoking product of claim 9, wherein the smoking material wrapper includes an inner wrapper which comes in contact with the smoking material portion and surrounds the smoking material portion and an outer wrapper which comes in contact with the inner wrapper and surrounds an outer portion of the inner wrapper.

14. The smoking product of claim 13, wherein a basis weight of the inner wrapper is less than or equal to a basis weight of the outer wrapper.

15. The smoking product of claim 14, wherein:

the basis weight of the inner wrapper is 20 $g/m^2$ to 30 $g/m^2$, a weight ratio of the filler with respect to the total weight of the inner wrapper is 20% to 40%, and a porosity of the inner wrapper is 40 CU to 50 CU; and the basis weight of the outer wrapper is 20 $g/m^2$ to 40 $g/m^2$, a weight ratio of the filler with respect to the total weight of the outer wrapper is 20% to 40%, and a porosity of the outer wrapper is 40 CU to 50 CU.

16. The smoking product of claim 1, wherein the capsule includes a first flavoring material containing menthol, lime oil, methyl salicylate, and peppermint oil.

17. The smoking product of claim 16, wherein a weight ratio of the menthol to the lime oil contained in the first flavoring material is 10:1 to 15:1, and a weight ratio of the lime oil to the methyl salicylate contained in the first flavoring material is 1.1:1 to 1.3:1.

18. The smoking product of claim 1, wherein the capsule includes a first flavoring material containing menthol, orange oil, cis-3-hexenol, and lemon oil.

19. The smoking product of claim 18, wherein a weight ratio of the menthol to the orange oil contained in the first flavoring material is 5:1 to 6:1, and a weight ratio of the orange oil to the cis-3-hexenol contained in the first flavoring material is 7:1 to 8:1.

20. The smoking product of claim 1, wherein a second filter is flavored with a second flavoring material containing menthol, cis-3-hexenol, and eucalyptol.

21. The smoking product of claim 20, wherein:

the second flavoring material further contains linalool; and a weight ratio of the menthol to the cis-3-hexenol contained in the second flavoring material is 40:1 to 50:1, and a weight ratio of the cis-3-hexenol to the linalool contained in the second flavoring material is 1.5:1 to 1.6:1.

22. The smoking product of claim 20, wherein:

the second flavoring material further contains hexanal; and a weight ratio of the menthol to the cis-3-hexenol contained in the second flavoring material is 35:1 to 45:1, and a weight ratio of the cis-3-hexenol to the hexanal contained in the second flavoring material is 2:1 to 3:1.

* * * * *